US010895258B2

(12) United States Patent
Hashimoto et al.

(10) Patent No.: US 10,895,258 B2
(45) Date of Patent: Jan. 19, 2021

(54) VACUUM PUMP

(71) Applicant: ULVAC, INC., Chigasaki (JP)

(72) Inventors: Kenji Hashimoto, Chigasaki (JP); Hideaki Inoue, Chigasaki (JP); Koji Shibayama, Chigasaki (JP); Toshio Suzuki, Chigasaki (JP)

(73) Assignee: ULVAC, INC., Chigasaki (JP)

( * ) Notice: Subject to any disclaimer, the term of this patent is extended or adjusted under 35 U.S.C. 154(b) by 0 days.

(21) Appl. No.: 16/783,756

(22) Filed: Feb. 6, 2020

(65) Prior Publication Data

US 2020/0173435 A1 Jun. 4, 2020

Related U.S. Application Data

(63) Continuation of application No. PCT/JP2018/012332, filed on Mar. 27, 2018.

(30) Foreign Application Priority Data

Aug. 7, 2017 (JP) ..... 2017-152740

(51) Int. Cl.
*F04C 2/18* (2006.01)
*F04C 29/04* (2006.01)
(Continued)

(52) U.S. Cl.
CPC ..... *F04C 15/0096* (2013.01); *F04C 2/18* (2013.01); *F04C 25/02* (2013.01)

(58) Field of Classification Search
CPC ..... F04C 15/0096; F04C 2/18; F04C 25/02
(Continued)

(56) References Cited

U.S. PATENT DOCUMENTS 9,080,571 B2 7/2015 Downham et al.
2001/0028858 A1 10/2001 Houze et al.
(Continued)

FOREIGN PATENT DOCUMENTS

CN 103582761 A 2/2014
JP 05-118288 A 5/1993
(Continued)

OTHER PUBLICATIONS

Office Action dated Apr. 3, 2020 in Chinese Application No. 201880031903.2, along with its English translation.
(Continued)

*Primary Examiner* — Connor J Tremarche
(74) *Attorney, Agent, or Firm* — Saliwanchik, Lloyd & Eisenschenk

(57) ABSTRACT

A vacuum pump according to an embodiment of the present invention includes a pump housing and a cooling pipe. The pump housing is constituted by cast iron. The cooling pipe includes an outer circumferential surface and an inner circumferential surface and is constituted by stainless steel. The cooling pipe passes through the pump housing and the outer circumferential surface which is in close contact with the pump housing, is constituted by a sensitized layer. This vacuum pump is formed such that the pump housing constituted by cast iron is casted around the cooling pipe constituted by stainless steel. The sensitized layer is provided on the outer circumferential surface of the cooling pipe, the sensitized layer is in contact with the pump housing, and the pump housing is efficiently cooled.

7 Claims, 4 Drawing Sheets

(51) Int. Cl.
*F04C 25/02* (2006.01)
*F04C 15/00* (2006.01)

(58) Field of Classification Search
USPC ..... 418/206.3
See application file for complete search history.

(56) References Cited

U.S. PATENT DOCUMENTS

| | | | | |
|---|---|---|---|---|
| 2013/0294957 | A1 | 11/2013 | Downham et al. | |
| 2016/0116227 | A1* | 4/2016 | Yamada | B23K 35/0244 165/10 |

FOREIGN PATENT DOCUMENTS

| | | | |
|---|---|---|---|
| JP | 10-099960 | A | 4/1998 |
| JP | 11-315794 | A | 11/1999 |
| JP | 2000-042717 | A | 2/2000 |
| JP | 2002-005023 | A | 1/2002 |
| JP | 2005-105829 | A | 4/2005 |
| JP | 2007-198239 | A | 8/2007 |
| JP | 2009-185778 | A | 8/2009 |
| JP | 2013-209959 | A | 10/2013 |
| JP | 2014-503049 | A | 2/2014 |
| TW | 201042150 | A | 12/2010 |
| WO | WO 2012/098386 | A2 | 7/2012 |

OTHER PUBLICATIONS

Office Action dated Jul. 24, 2020 in Chinese Application No. 201880031903.2, along with its English translation.

* cited by examiner

VACUUM PUMP

CROSS REFERENCE TO RELATED APPLICATIONS

This application is a continuation of International Patent Application No. PCT/JP2018/012332, filed Mar. 27, 2018, which claims priority to Japanese Patent Application No. 2017-152740, filed Aug. 7, 2017, the disclosures of each of which are incorporated herein by reference in their entirety.

BACKGROUND

A two-spindle screw pump, for example, is known as a positive displacement dry vacuum pump. The screw pump of this type includes a pair of screw rotors, a housing that houses the pair of screw rotors, and a drive mechanism that rotates the pair of screw rotors. Rotation of the pair of screw rotors transports gas from an intake port of the housing to an exhaust port, such that gas inside the vacuum container is exhausted (e.g., see Japanese Unexamined Patent Application Publication No. 2009-185778).

The housing may be heated at high temperature when the pair of screw rotors operates for a long time. Therefore, the housing is generally cooled by air cooling or water cooling. Then, in a situation where it is desirable to make the vacuum pump compact, it is important to provide a simple and highly efficient cooling structure in the housing which is a part of the vacuum pump.

SUMMARY

Regarding the above-mentioned cooling structure, a circulation-type cooling structure is desirable due to the necessity of a simple cooling structure. Further, water is generally used as a cooling medium. Water has higher cooling efficiency and is easier to be handled in comparison with oil and coolant liquid. Further, if the cooling medium is water, the cooling medium is suitable for a cooling pipe made of stainless steel highly resistant against water. It should be noted that in a case where the cooling pipe made of stainless steel is used, it is important to put the cooling pipe made of stainless steel into uniform close contact with the housing and inhibit an inner circumferential surface of the cooling pipe made of stainless steel from being sensitized.

In view of the above-mentioned circumstances, it is an object of the present invention to provide a vacuum pump including a housing having a cooling structure which is simple, has high cooling efficiency, and is excellent in productivity.

In order to accomplish the above-mentioned object, a vacuum pump according to an embodiment of the present invention includes a pump housing and a cooling pipe. The pump housing is constituted by cast iron. The cooling pipe includes an outer circumferential surface and an inner circumferential surface and is constituted by stainless steel. The cooling pipe passes through the pump housing. And the outer circumferential surface, which is in close contact with the pump housing, is constituted by a sensitized layer.

This vacuum pump is formed by casting the pump housing constituted by the cast iron around the cooling pipe constituted by the stainless steel. Accordingly, the vacuum pump including the cooling pipe that passes through the pump housing is easily formed. In addition, the sensitized layer is provided on the outer circumferential surface of the cooling pipe, the sensitized layer is in close contact with the pump housing, and the pump housing is efficiently cooled.

The vacuum pump may further include a first screw rotor that is housed in the pump housing and includes a helical first tooth and a second screw rotor including a helical second tooth that mesh with the first tooth.

With such a vacuum pump, even if the pair of screw rotors are operated for a long time, the pump housing is efficiently cooled by the cooling pipe provided in the pump housing.

In the vacuum pump, the cooling pipe includes a first cooling pipe portion and a second cooling pipe portion that is arranged in parallel with the first cooling pipe portion. The first screw rotor and the second screw rotor are sandwiched between the first cooling pipe portion and the second cooling pipe portion.

With such a vacuum pump, the first cooling pipe portion and the second cooling pipe portion are provided in the pump housing so as to sandwich the pair of screw rotors. Accordingly, the pump housing is uniformly cooled.

In the vacuum pump, the cooling pipe further includes a connection pipe portion that connects the first cooling pipe portion with the second cooling pipe portion and is provided outside the pump housing. The first cooling pipe portion, the connection pipe portion, and the second cooling pipe portion are connected in series in the stated order and are integrally configured.

With such a vacuum pump, the cooling pipe is configured in such a manner that the first cooling pipe portion, the connection pipe portion, and the second cooling pipe portion are connected in series and are integrally configured, and thus the cooling pipe has a simple configuration.

In the vacuum pump, a thickness of the cooling pipe may be 1 mm or more and 5 mm or less.

With such a vacuum pump, the thickness of the cooling pipe is set to be 1 mm or more and 5 mm or less. Therefore, at the time of casting, the inner circumferential surface of the cooling pipe constituted by the stainless steel is not molten and the outer circumferential surface is adequately molten, such that the outer circumferential surface of the cooling pipe is in contact with the pump housing.

In the vacuum pump, a thickness of the sensitized layer may be 0.3 mm.

With such a vacuum pump, at the time of casting the pump housing, even if the surface of the cooling pipe is heated due to the contact of the cooling pipe with the molten cast iron, the outer circumferential surface of the cooling pipe is sensitized and the inner circumferential surface is not sensitized. Accordingly, the sensitized layer is formed on the outer circumferential surface of the cooling pipe.

In the vacuum pump, a value obtained by dividing a capacity of the pump housing by a value obtained by multiplying a thickness of the cooling pipe by an area in which the cooling pipe is in contact with the pump housing may be 30 or more and 300 or less.

With such a vacuum pump, the division value is set to be 30 or more and 300 or less. Therefore, at the time of casting, the inner circumferential surface of the cooling pipe constituted by the stainless steel is not molten and the outer circumferential surface of the cooling pipe is in close contact with the pump housing.

These and other objects, features and advantages of the present disclosure will become more apparent in light of the following detailed description of best mode embodiments thereof, as illustrated in the accompanying drawings.

DETAILED DESCRIPTION OF EMBODIMENTS

Hereinafter, an embodiment of the present invention will be described with reference to the drawings. In each of the drawings, XYZ-axis coordinates are introduced in some cases.

Figure 1A:
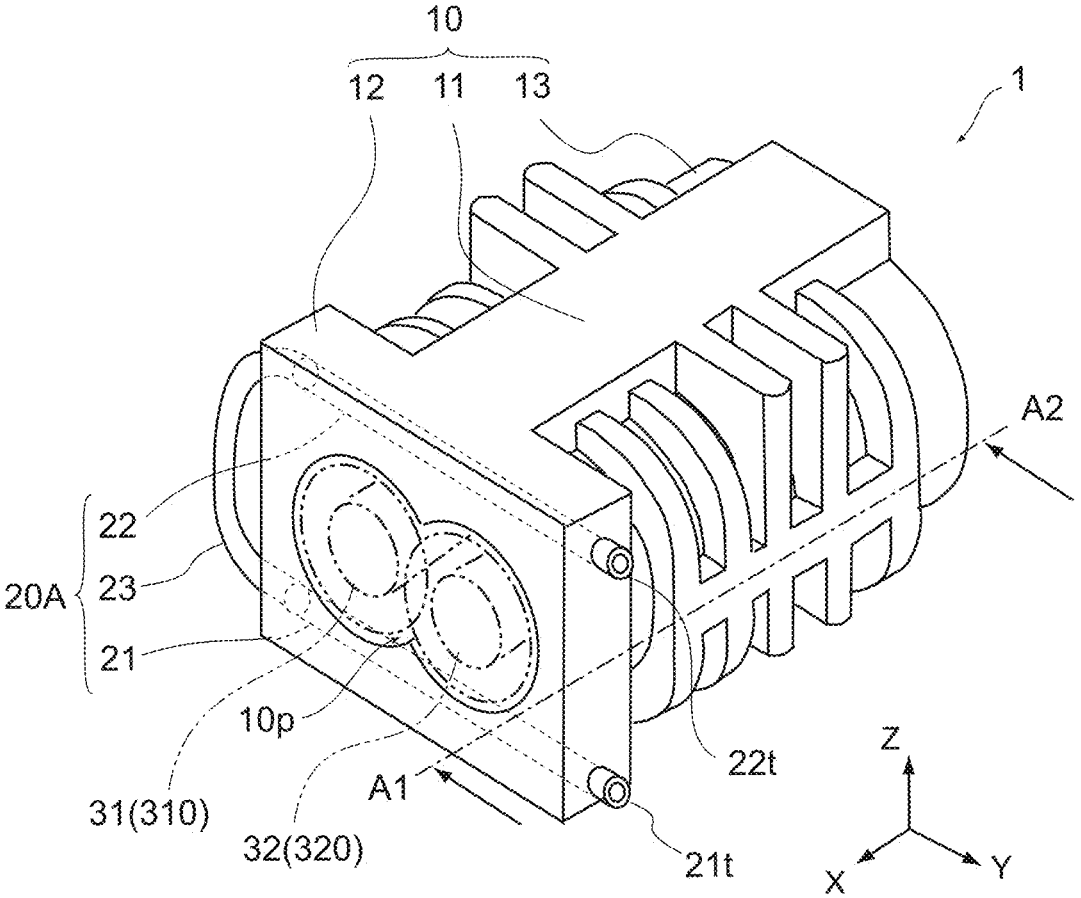
FIGS. 1A and 1B are schematic perspective views each showing main parts of a vacuum pump according to this embodiment.

FIG. 1A is a schematic perspective view showing main parts of a vacuum pump according to this embodiment.

FIG. 1A shows a pump housing 10. The pump housing 10 is a cylinder portion of a vacuum pump 1. Further, a part of a cooling pipe 20A is embedded in a pump housing 10. The pump housing 10 is applied to a two-spindle screw pump as an example. The vacuum pump according to this embodiment is not limited to the two-spindle screw pump. A roots dry pump, a rotary pump, or the like may be employed as the vacuum pump according to this embodiment.

The pump housing 10 includes a pump room 10*p* therein. The pump room 10*p* extends in the X-axis direction. A pair of screw rotors 31 and 32 can be disposed in the pump room 10*p*. In FIG. 1A, the pair of screw rotors 31 and 32 are indicated by two-dot chain lines for describing the configuration of the pump housing 10. The pair of screw rotors 31 and 32 are arranged in the Y-axis direction inside the pump room 10*p*.

The pump housing 10 includes a first housing portion 11, a second housing portion 12, and a third housing portion 13. The first housing portion 11 is provided between the second housing portion 12 and the third housing portion 13. The first housing portion 11, the second housing portion 12, and the third housing portion 13 are integrally configured by casting.

The first housing portion 11 and the second housing portion 12 function as a container that houses teeth portions of the pair of screw rotors 31 and 32, for example. In addition, the second housing portion 12 functions as a flange that allows the pair of screw rotors 31 and 32 to pass through it and is connected to a drive mechanism that drives the pair of screw rotors 31 and 32, for example. Further, the third housing portion 13 closes the pump room 10*p* on the opposite side of the second housing portion 12.

The material of the pump housing 10 is cast iron such as FC250, for example. Such a vacuum pump 1 including the pump housing 10 made of cast iron has a high melting point. The metallographic structure of the vacuum pump 1 does not easily change even if the vacuum pump 1 is at high temperature. Further, the linear expansion coefficient of cast iron is low and influence of dimension change due to thermal expansion is small even if the vacuum pump 1 operates at high temperature. Further, the hardness of cast iron is high and cast iron is not likely to be crushed also when it absorbs a foreign matter. Further, the cast iron has high resistance to corrosive gas such as ammonium.

A part of the cooling pipe 20A passes through the second housing portion 12. That is, a part of the cooling pipe 20A is provided inside the second housing portion 12. The cooling pipe 20A includes a first cooling pipe portion 21, a second cooling pipe portion 22, and a connection pipe portion 23. The first cooling pipe portion 21 and the second cooling pipe portion 22 each linearly extend in the Y-axis direction and are arranged in parallel in the Z-axis direction. The connection pipe portion 23 connects the first cooling pipe portion 21 with the second cooling pipe portion 22.

The first cooling pipe portion 21, the connection pipe portion 23, and the second cooling pipe portion 22 are connected in series in the stated order. An end portion 21*t* of the first cooling pipe portion 21 and an end portion 22*t* of the second cooling pipe portion 22 each protrude from the second housing portion 12. The connection pipe portion 23 is provided outside the second housing portion 12. One end portion of the connection pipe portion 23 is connected to the other end portion of the first cooling pipe portion 21. The other end portion of the connection pipe portion 23 is connected to the other end portion of the second cooling pipe portion 22.

If the cooling pipe 20A is viewed in the X-axis direction, the outer shape is a U-shape. Here, the first screw rotor 31 and the second screw rotor 32 are sandwiched between the first cooling pipe portion 21 and the second cooling pipe portion 22 in the Z-axis direction. The connection pipe portion 23, the first screw rotor 31, and the second screw rotor 32 are arranged in the Y-axis direction.

The first cooling pipe portion 21, the connection pipe portion 23, and the second cooling pipe portion 22 are an integral object made of the same material. For example, the cooling pipe 20A is formed by bending a single long metal pipe by a pipe bending machine or a manual tool such as a pipe bender. The cooling pipe 20A is made of stainless steel such as SUS304 and SUS316.

For example, a part of the cooling pipe 20A is set in a mold for forming the pump housing 10 in advance and molten cast iron is poured in this mold. Accordingly, molten cast iron comes in contact with the outer circumferential surface of the cooling pipe 20A. As a result, the pump housing 10 in which the cooling pipe 20A is formed inside the second housing portion 12 is formed.

Figure 1B:
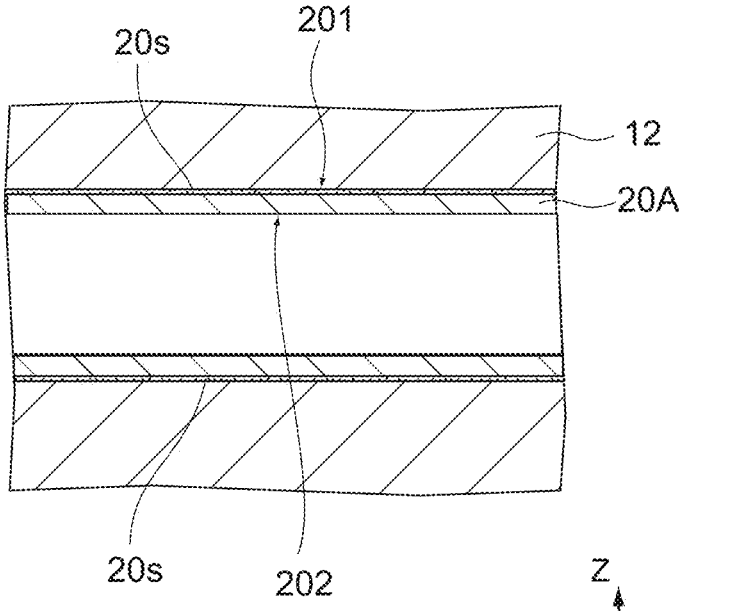

The cooling pipe 20A includes an outer circumferential surface 201 and an inner circumferential surface 202 (FIG. 1B). The outer circumferential surface 201 of the cooling pipe 20A is in contact with the second housing portion 12. The inner circumferential surface 202 is in contact with a medium flowing through the cooling pipe 20A. The medium is water, oil, coolant liquid, or the like, for example. When molten cast iron is poured in the mold for forming the pump housing 10, the outer circumferential surface 201 of the cooling pipe 20A comes in contact with the molten cast iron and the outer circumferential surface 201 of the cooling pipe 20A receives heat from the molten cast iron.

Accordingly, the outer circumferential surface 201 of the cooling pipe 20A is heated (500° C. or more and 850° C. or less) and the outer circumferential surface 201 of the cooling pipe 20A is sensitized. Here, sensitization is a phenomenon that, for example, chromium and carbon included in the stainless steel are coupled to each other and chromium carbide is precipitated along a grain boundary of the stainless steel. As a result, after casting of the pump housing 10 is completed, the outer circumferential surface 201 of the cooling pipe 20A is constituted by a sensitized layer 20*s* and the outer circumferential surface 201 of the cooling pipe 20A closely contacts the pump housing 10.

In other words, when the pump housing 10 is casted with molten cast iron, the molten cast iron and the outer circumferential surface 201 of the cooling pipe 20A are closely contacted with each other and the outer circumferential surface 201 of the cooling pipe 20A is heated by the molten cast iron. In this manner, the outer circumferential surface 201 of the cooling pipe 20A is sensitized. Further, since the outer circumferential surface 201 of the cooling pipe 20A is heated by the molten cast iron such that it can be sensitized, solid solution occurs between the cooling pipe 20A and the second housing portion 12 in some degree. Accordingly, the outer circumferential surface 201 of the cooling pipe 20A closely contacts the pump housing 10.

Figure 2:
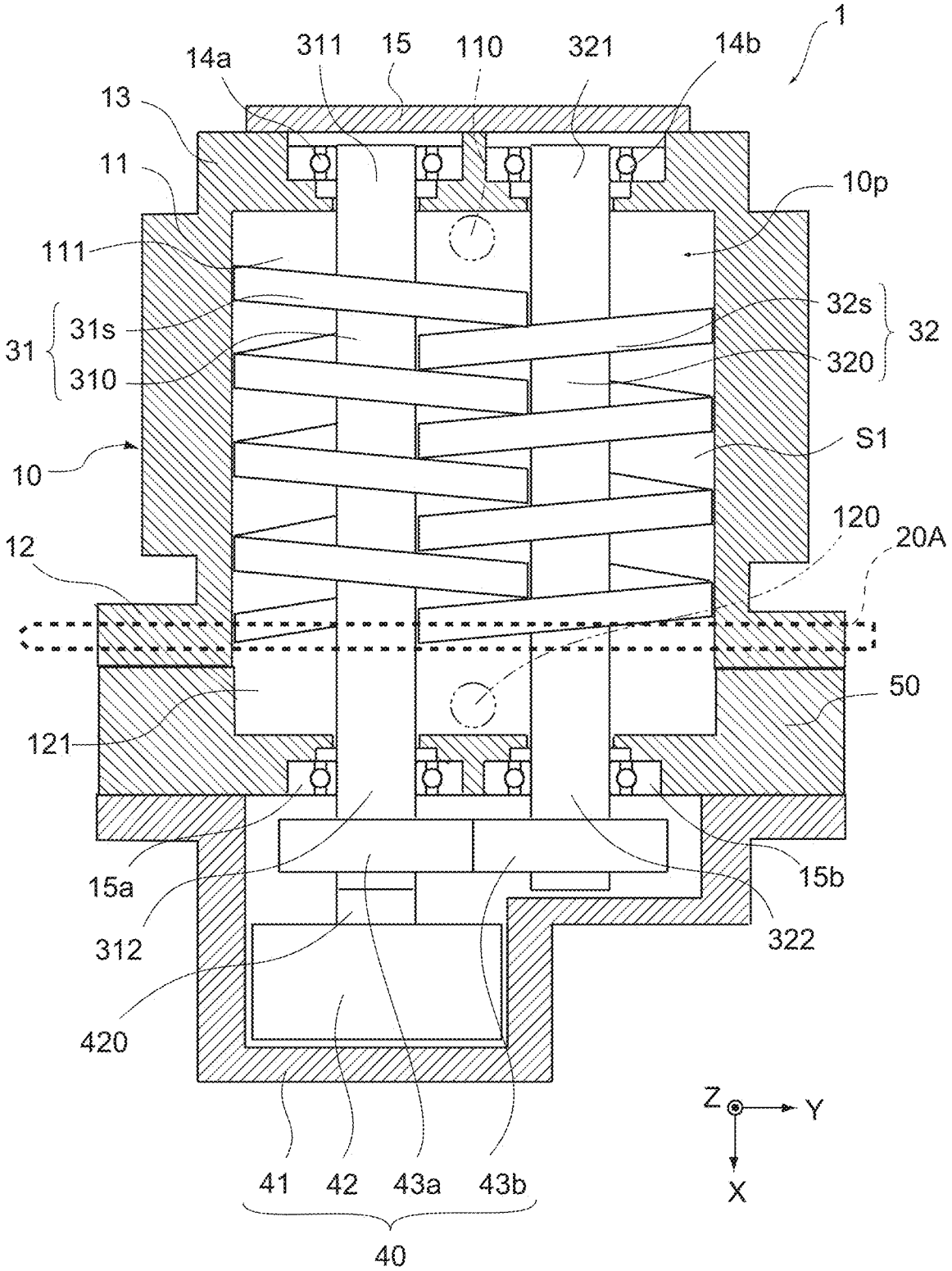
FIG. 2 is a schematic cross-sectional view showing inner main parts of the vacuum pump according to this embodiment.

FIG. 2 is a schematic cross-sectional view showing inner main parts of the vacuum pump according to this embodiment.

FIG. 2 shows a cross-section in an X-Y plane which is taken along the line A1-A2 of FIG. 1A. FIG. 2 also shows a drive mechanism 40, a middle housing 50, and the like which are not shown in FIG. 1A.

The screw rotors 31 and 32 each include a shaft center parallel to the X-axis direction. The screw rotors 31 and 32 are each arranged in the first housing portion 11 such that the screw rotors 31 and 32 are adjacent to each other in the Y-axis direction. The first screw rotor 31 includes a helical first tooth 31*s*. The second screw rotor 32 includes a helical second tooth 32*s*. The helical second tooth 32*s* mesh with the first tooth 31*s*. The number of turns of each of the first tooth 31*s* and the second tooth 32*s* is not limited to the number shown in the figure.

The first tooth 31*s* and the second tooth 32*s* each have an approximately identical shape except for the fact that helical directions are opposite to each other. The first tooth 31*s* is wound around a shaft portion 310 of the first screw rotor 31, having an identical diameter. The second tooth 32*s* is wound around a shaft portion 320 of the second screw rotor 32, having an identical diameter.

The first tooth 31*s* and the second tooth 32*s* mesh with each other. For example, the first tooth 31*s* is positioned in grooves between tooth parts of the second tooth 32*s*. A clearance is provided between such a groove and the first tooth 31*s*. Similarly, the second tooth 32*s* is positioned in grooves between tooth parts of the first tooth 31*s*. A clearance is provided between such a groove and the second tooth 32*s*.

The outer circumferential surface of the first tooth 31*s* faces the inner wall surface of the pump housing 10 and an outer circumferential surface of the shaft portion 320 of the second screw rotor 32 with a slightly clearance. The outer circumferential surface of the second tooth 32*s* faces the inner wall surface of the pump housing 10 and an outer circumferential surface of the shaft portion 310 of the first screw rotor 31 with a slightly clearance.

In the pump housing 10, the first housing portion 11 is a cylindrical container. The second housing portion 12 and the third housing portion 13 are respectively flanges connected to the first housing portion 11 on both sides. It should be noted that the pump room 10*p* passes through the second housing portion 12.

A shaft end portion 311 of the first screw rotor 31 and a shaft end portion 321 of the second screw rotor 32 are each inserted into the third housing portion 13. Further, a bearing 14*a* is provided between the shaft end portion 311 and the third housing portion 13 and a bearing 14*b* is provided between the shaft end portion 321 and the third housing portion 13. The shaft end portion 311 is rotatably supported to the third housing portion 13 via the bearing 14*a* and the shaft end portion 321 is rotatably supported to the third housing portion 13 via the bearing 14*b*.

A cover 15 that covers the bearings 14*a* and 14*b* is airtightly fixed on the third housing portion 13 by bolting via a seal member such as an O-ring or the like. Accordingly, the airtightness of the pump room 10*p* is secured.

The cooling pipe 20A is provided inside the second housing portion 12. In addition, the first screw rotor 31 and the second screw rotor 32 are inserted into the second housing portion 12.

The middle housing 50 is provided between the pump housing 10 and the drive mechanism 40. The middle housing 50 is airtightly fixed on the second housing portion 12 by bolting via a seal member such as an O-ring or the like, for example. Accordingly, the airtightness of the pump room 10*p* is secured.

A shaft end portion 312 of the first screw rotor 31 and a shaft end portion 322 of the second screw rotor 32 are inserted into the middle housing 50. A bearing 15*a* is provided between the shaft end portion 312 and the middle housing 50. A bearing 15*b* is provided between the shaft end portion 322 and the middle housing 50. The shaft end portion 312 is rotatably supported by the middle housing 50 via the bearing 15*a*. The shaft end portion 322 is rotatably supported by the middle housing 50 via the bearing 15*b*.

The drive mechanism 40 includes a motor casing 41, a motor 42, a first timing gear 43*a*, and a second timing gear 43*b*. The motor 42, the first timing gear 43*a*, and the second timing gear 43*b* are housed in the motor casing 41. The motor casing 41 is airtightly fixed on the middle housing 50 by bolting via a seal member such as an O-ring or the like, for example.

The motor 42 includes a DC motor and the like, for example. A drive shaft 420 of the motor 42 is connected to a shaft end portion 312 of the first screw rotor 31. The motor 42 rotates the first screw rotor 31 around the shaft at predetermined rotation speed.

The first timing gear 43*a* is mounted on the shaft end portion 312 of the first screw rotor 31. The second timing gear 43*b* is mounted on a shaft end portion 322 of the second screw rotor 32. The timing gears 43*a* and 43*b* are arranged in the Y-axis direction such that timing gears 43*a* and 43*b* mesh with each other. Accordingly, when the first screw rotor 31 is rotated, the rotational driving force of the first screw rotor 31 is transferred to the second screw rotor 32.

Here, a space defined by the third housing portion 13, the first housing portion 11, the first tooth 31*s*, and the second tooth 32*s* is referred to as an intake room 111, and a space defined by the second housing portion 12, the middle housing 50, the first tooth 31*s*, and the second tooth 32*s* is referred to as a gas exhaust room 121. Then, the intake room 111 is continuous with an intake port 110 and the gas exhaust room 121 is continuous with an exhaust port 120. The intake port 110 is connected to an inner space of a vacuum chamber not shown in the figure. The exhaust port 120 is connected to the atmosphere, an auxiliary pump (not shown), or an apparatus that processes exhausted gas.

Each of the screw rotors 31 and 32 rotates in opposite directions by driving of the motor 42. The drive mechanism 40 transports a working space S1 from the side of the intake port 110 toward the exhaust port 120. The working space S1 is formed between the first screw rotor 31, the second screw rotor 32, and the first housing portion 11. Accordingly, the gas taken in through the intake port 110 is exhausted from the exhaust port 120 by conveying with the transporting working space S1.

In this case, gas flowing into the intake room 111 from the intake port 110 is transported by the screw rotors 31 and 32 toward the exhaust port 120 and is compressed in the gas exhaust room 121. Here, a final stage has a maximum pressure difference in the working space S1 partitioned into plural rooms. The working space which is the previous stage of the final stage has a lower pressure, and the temperature is likely to increase in the final stage due to heat of compression at the final stage having a pressure closer to the atmospheric pressure even if the compression ratio is the same. Accordingly, the second housing portion 12 adjacent to the gas exhaust room 121 may have a particularly high temperature by heat of compression. Therefore, it is important to cool the second housing portion 12 efficiently with a simple structure in the vacuum pump 1.

Hereinafter, some methods for cooling the second housing portion 12 will be described as comparative examples.

For example, as a comparative example which cools the second housing portion 12, there is a method of forming a hole in the second housing portion 12 by drilling and inserting a cooling pipe through this hole. In this method, grease as a heating medium is provided between the cooling pipe and the second housing portion 12.

However, in this method, drilling for forming the hole is required in the second housing portion 12. Further, the hole formed by drilling is generally linearly formed. Then, the U-shaped cooling pipe cannot be inserted into the hole. It is necessary to connect multiple cooling pipes in U-shape for configuring the cooling pipe into U-shape. It makes the configuration of the cooling pipe complicated. Further, when grease between the cooling pipe and the second housing portion 12 is provided, thermal conductivity between the cooling pipe and the second housing portion 12 may be lowered. Further, it is also necessary to re-grease regularly as maintenances.

Further, as another comparative example which cools the second housing portion 12, for example, there is a method that a pipe line is formed on a thick plate made of aluminum, a stainless pipe is casted in the pipe line, a cooling plate is contacted to the second housing portion 12 via grease, and water is circulated through the stainless pipe.

However, this method is contrary to the downsizing of the vacuum pump, and causes an increase in the cost of the vacuum pump. Further, the cooling efficiency is lower in comparison with the method of cooling the second housing portion 12 through the cooling pipe 20A in this method. Further, there is still a similar problem regarding grease.

Further, as still another comparative example which cools the second housing portion 12, there is a method that a heating medium is circulated and the second housing portion 12 is cooled by indirect cooling via the heating medium.

However, this method leads to an increase in costs because it is necessary to add a fan mechanism that cools the heating medium and to provide pipes for circulating the heating medium. In addition, in this method, the second housing portion 12 is indirectly cooled via the heating medium. Therefore, the cooling efficiency is lower in comparison with the method for cooling the second housing portion 12 by the cooling pipe 20A.

In this embodiment, the second housing portion 12 is casted in contact with a part of the cooling pipe 20A without forming the hole in the second housing portion 12 by drilling, such that the vacuum pump 1 in which a part of the cooling pipe 20A is provided inside the second housing portion 12 is formed. Accordingly, the vacuum pump 1 in which the cooling pipe 20A is provided inside the second housing portion 12 is more easily formed.

Here, the outer circumferential surface 201 of the cooling pipe 20A is in close contact with the second housing portion 12 because the outer circumferential surface 201 of the cooling pipe 20A is constituted by the thin sensitized layer 20*s*. Even if the outer circumferential surface 201 of the cooling pipe 20A is constituted by the sensitized layer 20*s*, the sensitized layer 20*s* is in contact with the cast iron, is not in contact with water and the like. Therefore, the cooling pipe 20A does not corrode from the outer circumferential surface 201.

Figure 3:
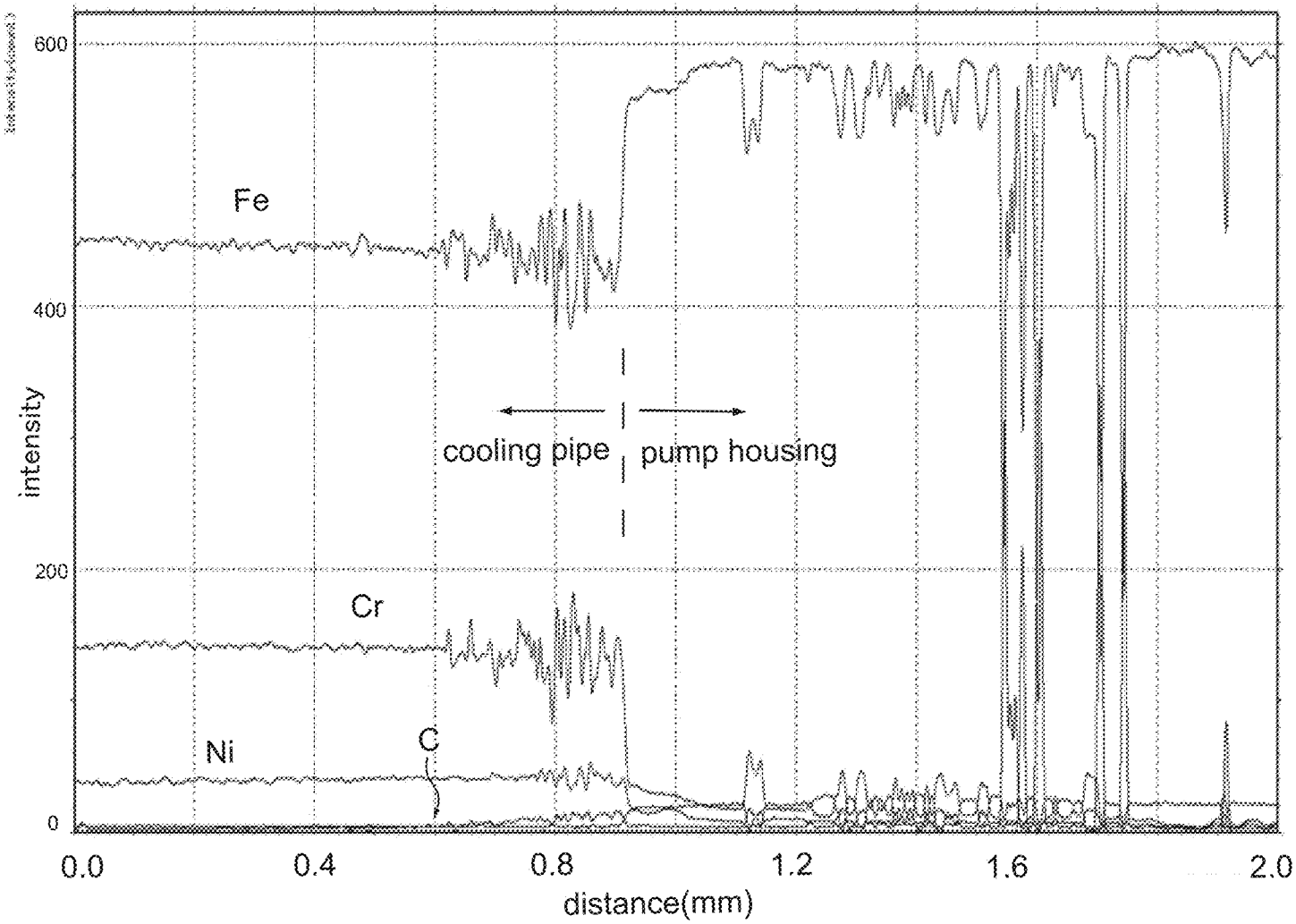
FIG. 3 is an electron probe micro analyzer result in vicinity of an outer circumferential surface of a cooling pipe.

For example, FIG. 3 shows an electron probe micro analyzer result in vicinity of the outer circumferential surface of the cooling pipe. The horizontal axis indicates a distance (depth) (mm) in a direction from the inside of the cooling pipe 20A toward the second housing portion 12. The vertical axis indicates X-ray intensity. A beam diameter of an electron beam is 2 μm, for example.

As shown in FIG. 3, the Fe strength and the Cr strength are approximately constant up to the distance 0.6 mm. The Fe strength and the Cr strength significantly change beyond the distance of 0.6 mm. In addition, the Fe strength and the Cr strength extremely change beyond a distance of about 0.9 mm. Considering that a main component of cast iron is iron and stainless steel is a mixture of iron and chromium, it can be said that the position at the distance of 0.9 mm corresponds to the position of the boundary between the cooling pipe 20A and the second housing portion 12.

Further, in a region from the distance of 0.6 mm to the distance of 0.9 mm (the boundary between the cooling pipe 20A and the second housing portion 12), the Fe strength and the Cr strength significantly change. Considering that the Fe strength and the Cr strength are approximately constant in a region from the distance 0 mm to the distance 0.6 mm and a sensitization phenomenon that chromium is coupled to carbon in stainless steel and chromium carbide is precipitated along a grain boundary of the stainless steel, it can be said that the sensitized layer 20*s* is formed in a region from the distance of 0.6 mm to the distance of 0.9 mm.

In addition, a very small amount of Cr and Ni in the cooling pipe 20A is detected also beyond the distance of 0.9 mm. Therefore, it can be said that solid solution progresses between the cooling pipe 20A and the second housing portion 12 to some extent.

Since the thickness of the sensitized layer 20*s* is 1 mm or less, the thickness of the cooling pipe 20A is favorably 1 mm or more and 5 mm or less.

In a case where the thickness of the cooling pipe 20A is smaller than 1 mm, there are some fears that most of the volume of the cooling pipe 20A is constituted by the sensitized layer 20*s*, so that the cooling pipe 20A corrodes from the inner circumferential surface 202 and that a part of the cooling pipe 20A is molten at the time of casting the pump housing 10 and some holes may be formed between the outer circumferential surface 201 and the inner circumferential surface 202. For example, in a case where the pump housing 10 is casted by using a cooling pipe having a thickness of 1 mm, a part of the cooling pipe may be molten and some holes may be formed between the outer circumferential surface and the inner circumferential surface.

On the other hand, if the thickness of the cooling pipe 20A is larger than 5 mm, the volume of the cooling pipe 20A is larger. Therefore, the outer circumferential surface 201 of the cooling pipe 20A is not sufficiently heated at the time of casting the pump housing 10 and solid solution does not easily progress between the cooling pipe 20A and the second housing portion 12. Accordingly, there is a region in which the outer circumferential surface 201 of the cooling pipe 20A is not in close contact with the second housing portion 12. Correspondingly, heat removal capability is lowered. Further, if the thickness of the cooling pipe 20A is larger than 5 mm, the strength of the cooling pipe 20A itself increases and bending of the connection pipe portion 23 becomes difficult. It should be noted that "close contact" in this embodiment means that the outer circumferential surface of the cooling pipe 20A is welded to the second housing portion 12.

The fact that the thickness of the sensitized layer 20*s* is smaller than 0.3 mm means that the outer circumferential surface 201 of the cooling pipe 20A is not sufficiently heated by the molten cast iron. Solid solution does not easily progress between the cooling pipe 20A and the second housing portion 12.

On the other hand, in a case where the thickness of the sensitized layer 20*s* is larger than 0.3 mm, most of the volume of the cooling pipe 20A is constituted by the sensitized layer 20*s*, and there is a fear that the cooling pipe 20A corrodes from the inner circumferential surface 202.

Further, in this embodiment, a value A obtained by dividing a capacity of the pump housing 10 by a value obtained by multiplying the thickness of the cooling pipe 20A by an area in which the cooling pipe 20A is in contact with the pump housing 10 is favorably 30 or more and 300 or less.

If the value A is smaller than 30, the cooling pipe 20A is not sufficiently heated at the time of casting the pump housing 10 and solid solution does not progress between the cooling pipe 20A and the second housing portion 12. There is thus a possibility that the outer circumferential surface 201 of the cooling pipe 20A is not in close contact with the second housing portion 12.

On the other hand, if the value A is larger than 300, there are some fears that most of the volume of the cooling pipe 20A is constituted by the sensitized layer 20*s* and the cooling pipe 20A corrodes from the inner circumferential surface 202 or a part of the cooling pipe 20A is molten at the time of casting the pump housing 10 and some holes are formed between the outer circumferential surface 201 and the inner circumferential surface 202.

It should be noted that the sensitized layer is not formed on the inner circumferential surface 202 of the cooling pipe 20A, or the sensitized layer is not easily formed in comparison with the outer circumferential surface 201. It is because the inner circumferential surface 202 is does not directly contact to the molten cast iron at the time of casting the pump housing 10. Further, in order to suppress sensitization of the inner circumferential surface 202 as much as possible, water may be flow into the cooling pipe 20A at the time of casting the pump housing 10 or water may be housed in the cooling pipe 20A. In flow examination of the cooling pipe 20A, the inner circumferential surface 202 does not corrode or corrosion is suppressed at a level which is not problematic in practice.

It should be noted that the sensitization phenomenon caused by the stainless steel can also be avoided by forming an electroless nickel plating film on an inner circumferential surface of a pipe formed of iron as the cooling pipe 20A in view of rust prevention. However, close-contact property of the plating film cannot be secured, and the plating film may be pealed from the pin holes if pin holes are generated in the plating film. Further, expansion and contraction of the cooling pipe 20A are repeated due to thermal history for a long time, the plating film is more easily pealed. Further, it is difficult to uniformly form the plating film on the inner circumferential surface 202 of the cooling pipe 20A in terms of both the technology and costs.

Therefore, like this embodiment, the pump housing 10 with the cooling pipe 20A, which does not have problem in terms of corrosion in practice, is easily formed by casting the cooling pipe 20A having a thickness of 1 mm or more and 5 mm or less together with the cast iron.

Further, according to this embodiment, the cooling pipe 20A is in direct contact with the second housing portion 12. Therefore, it is unnecessary to provide grease between the outer circumferential surface 201 of the cooling pipe 20A and the second housing portion 12. Accordingly, the pump housing 10 is efficiently cooled by a medium flowing through the cooling pipe 20A.

Further, according to this embodiment, the first cooling pipe portion 21, the connection pipe portion 23, and the second cooling pipe portion 22 are integrally configured in the U-shaped cooling pipe 20A, and thus it is unnecessary to connect multiple cooling pipes into the U-shape and the configuration of the cooling pipe becomes simple.

Further, according to this embodiment, a part of the cooling pipe 20A is provided inside the second housing portion 12. Therefore, the vacuum pump 1 becomes compact and an increase in costs can be suppressed.

Further, according to this embodiment, the second housing portion 12 includes the first cooling pipe portion 21 and the second cooling pipe portion 22 to sandwich the pair of screw rotors 31 and 32. Accordingly, the second housing portion 12 is uniformly cooled by the first cooling pipe portion 21 and the second cooling pipe portion 22.

Further, according to this embodiment, the thickness of the cooling pipe 20A is set to be 1 mm or more and 5 mm or less. Therefore, screw threads can be formed in the inner circumferential surface 202 of each of the end portion 21*t* and the end portion 22*t* and a pipe can be easily connected to one of screw threads by screw connection.

Figure 4A:
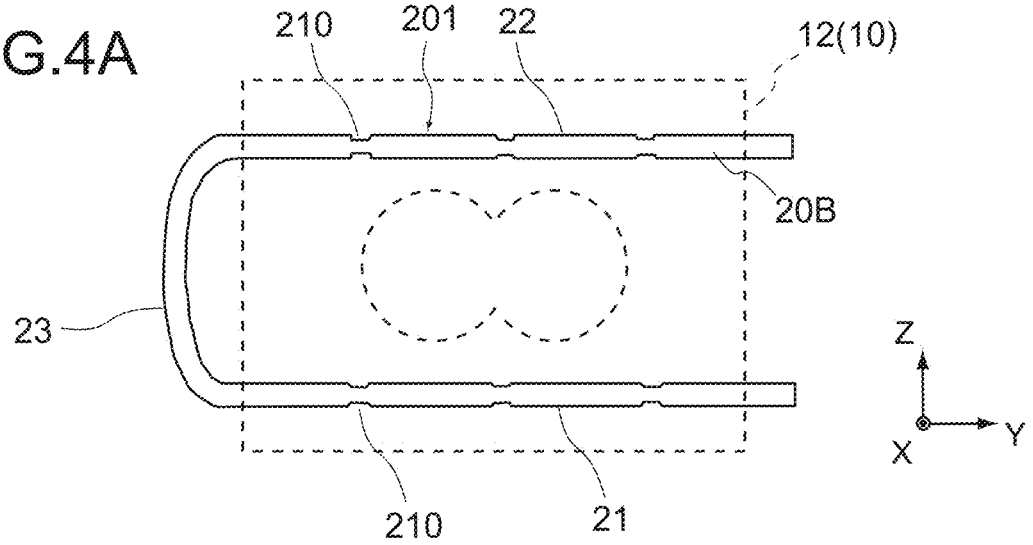
FIGS. 4A to 4C are schematic views each showing a modified example of the cooling pipe according to this embodiment.
Figure 4B:
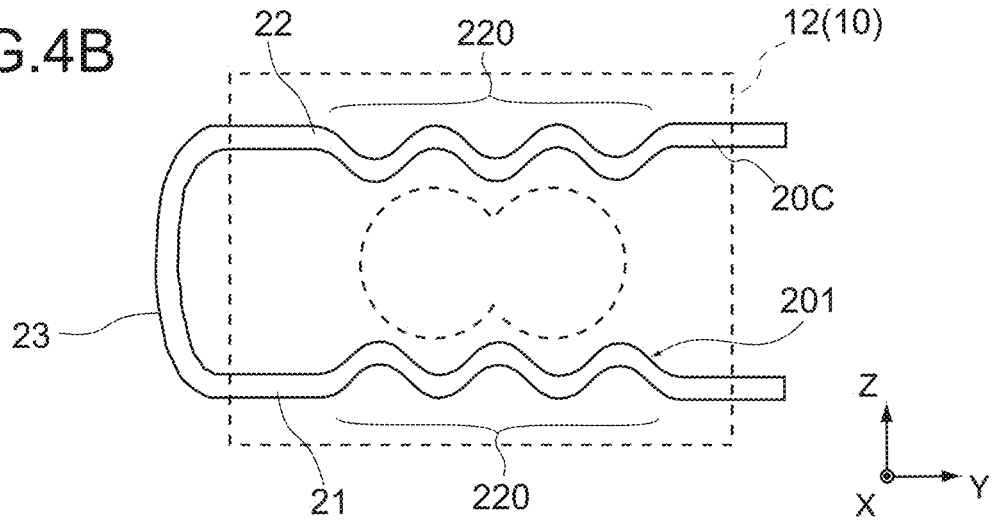
Figure 4C:
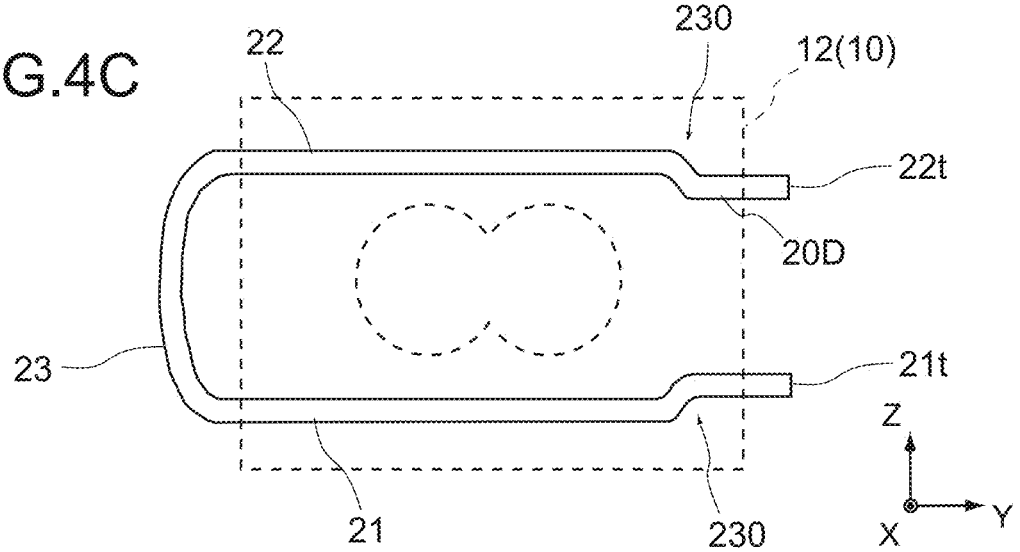

FIGS. 4A to 4C are schematic views each showing a modified example of the cooling pipe according to this embodiment.

A cooling pipe 20B shown in FIG. 4A includes cutouts 210. The cutouts 210 are provided in respective outer circumferential surfaces 201 of a first cooling pipe portion 21 and a second cooling pipe portion 22. The number of cutouts 210 is not limited to the number shown in the figure. With such a cooling pipe 20B, a contact area of the outer circumferential surface 201 of the cooling pipe 20B with a second housing portion 12 increases and the cooling efficiency of the second housing portion 12 further increases.

In a cooling pipe 20C shown in FIG. 4B, each of a first cooling pipe portion 21 and a second cooling pipe portion 22 includes a wavy structure 220 (e.g., a cine waveform structure). The number of one of waves and pitch are not limited to the number shown in the figure. With such a cooling pipe 20C, a contact area of an outer circumferential surface 201 of the cooling pipe 20C with a second housing portion 12 increases and the cooling efficiency of the second housing portion 12 further increases.

In a cooling pipe 20D shown in FIG. 4C, each of a first cooling pipe portion 21 and a second cooling pipe portion 22 includes a bent portion 230. Accordingly, a position of an end portion 21*t* of the first cooling pipe portion 21 or an end portion 22*t* of the second cooling pipe portion 22 can be located in different from the position of a cooling pipe 20A. That is, according to the cooling pipe structure in this embodiment, the degree of freedom of arrangement of the end portions 21*t* and 22*t* increases.

Hereinabove, the embodiment of the present invention has been described. The present invention is not limited only to the above-mentioned embodiment and various modifications can be made as a matter of course. For example, although the third housing portion 13 is integrally formed in the pump housing 10, a separated structure may be employed. The cooling pipe 20A is configured in the U-shape with respect to the YZ-axis plane for making heat removal uniform. Alternatively, in order to control the heat removal portion, the cooling pipe 20A may be optionally configured in the I-shape, the U-shape or I-shape or the like may be optionally configured on the XY-axis plane, two or more connection pipe portions and cooling pipes may be provided, or two or more sets of them may be disposed. Further, in a case of using a roots pump or a rotary pump, the shape of the pump housing is changed as appropriate and the cooling pipe is disposed in an optimal location.

It should be understood by those skilled in the art that various modifications, combinations, sub-combinations and alterations may occur depending on design requirements and other factors insofar as they are within the scope of the appended claims or the equivalents thereof.

What is claimed is:

1. A vacuum pump, comprising:

a pump housing constituted by cast iron; and a cooling pipe which includes an outer circumferential surface and an inner circumferential surface, is constituted by stainless steel, and passes through the pump housing, the outer circumferential surface being in close contact with the pump housing, the outer circumferential surface having a sensitized layer, solid solution between the sensitized layer and the pump housing being progressed, a liquid medium flowing through the cooling pipe, an interior space as a pump room being provided inside the pump housing, a thickness of the cooling pipe being 1 mm or more and 5 mm or less, and a first value being 30 or more and 300 or less, the first value being obtained by dividing a capacity of the pump housing except for the interior space by a second value, and the second value being obtained by multiplying the thickness of the cooling pipe by an area in which the cooling pipe is in contact with the pump housing.

2. A vacuum pump, comprising:

a pump housing constituted by cast iron, a cooling pipe which includes an outer circumferential surface and an inner circumferential surface, is constituted by stainless steel, and passes through the pump housing, the outer circumferential surface being in close contact with the pump housing, the outer circumferential surface having a layer, alloy composition of each of the stainless steel and the cast iron being changed in the layer, a thickness of the layer being at least 0.3 mm, solid solution between the layer and the pump housing being progressed, a liquid medium flowing through the cooling pipe, an interior space as a pump room being provided inside the pump housing, a thickness of the cooling pipe being 1 mm or more and 5 mm or less, and a first value being 30 or more and 300 or less, the first value being obtained by dividing a capacity of the pump housing except for the interior space by a second value, and the second value being obtained by multiplying a thickness of the cooling pipe by an area in which the cooling pipe is in contact with the pump housing.

3. The vacuum pump according to claim 1, further comprising:

a first screw rotor including a helical first tooth; and a second screw rotor including a helical second tooth that mesh with the first tooth, and the first screw rotor and the second screw rotor being housed in the pump housing.

4. The vacuum pump according to claim 1, wherein the cooling pipe includes a first cooling pipe portion, and a second cooling pipe portion arranged in parallel with the first cooling pipe portion, and the first screw rotor and the second screw rotor are sandwiched by the first cooling pipe portion and the second cooling pipe portion.

5. The vacuum pump according to claim 4, wherein the cooling pipe further includes a connection pipe portion that connects the first cooling pipe portion with the second cooling pipe portion, and the cooling pipe is provided outside the pump housing, and the first cooling pipe portion, the connection pipe portion, and the second cooling pipe portion are connected in series and are integrally configured.

6. The vacuum pump according to claim 4, wherein the outer circumferential surface of each of the first cooling pipe portion and the second cooling pipe portion includes at least one cutout.

7. The vacuum pump according to claim 1, wherein a thickness of the sensitized layer is 0.3 mm.

* * * * *